US011830643B2

(12) United States Patent
Park et al.

(10) Patent No.: US 11,830,643 B2
(45) Date of Patent: Nov. 28, 2023

(54) COIL ELECTRONIC COMPONENT

(71) Applicant: SAMSUNG ELECTRO-MECHANICS CO., LTD., Suwon-si (KR)

(72) Inventors: Il Jin Park, Suwon-si (KR); Joong Won Park, Suwon-si (KR); Se Hyung Lee, Suwon-si (KR); Soon Kwang Kwon, Suwon-si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 944 days.

(21) Appl. No.: 16/562,826

(22) Filed: Sep. 6, 2019

(65) Prior Publication Data

US 2020/0143972 A1 May 7, 2020

(30) Foreign Application Priority Data

Nov. 2, 2018 (KR) ..... 10-2018-0133371

(51) Int. Cl.
*H01F 27/25* (2006.01)
*H01F 27/255* (2006.01)
*H01F 27/29* (2006.01)

(52) U.S. Cl.
CPC ..... *H01F 27/255* (2013.01); *H01F 27/29* (2013.01)

(58) Field of Classification Search
CPC .. H01F 27/255; H01F 27/29; H01F 2003/106; H01F 2017/048; H01F 3/10; H01F 2017/0066; H01F 17/0013; H01F 17/04; H01F 17/0006; H01F 27/292
USPC ..... 336/221, 200, 192
See application file for complete search history.

(56) References Cited

U.S. PATENT DOCUMENTS

| | | | | |
|---|---|---|---|---|
| 6,603,382 | B1 | 8/2003 | Komai et al. | |
| 10,861,630 | B2 * | 12/2020 | Ryu | H01F 3/10 |
| 2009/0256668 | A1 * | 10/2009 | Noma | H01F 17/0013 336/200 |
| 2013/0033354 | A1 | 2/2013 | An et al. | |
| 2013/0154780 | A1 * | 6/2013 | Yamada | H01F 27/29 336/175 |
| 2014/0167897 | A1 | 6/2014 | Choi et al. | |

(Continued)

FOREIGN PATENT DOCUMENTS

| | | | |
|---|---|---|---|
| JP | 2000-357612 | A | 12/2000 |
| JP | 2013-033966 | A | 2/2013 |

(Continued)

OTHER PUBLICATIONS

Japanese Office Action dated Sep. 1, 2020 issued in Japanese Patent Application No. 2019-162398 (with English translation).

*Primary Examiner* — Shawki S Ismail
*Assistant Examiner* — Kazi S Hossain
(74) *Attorney, Agent, or Firm* — Morgan, Lewis & Bockius LLP

(57) ABSTRACT

A coil electronic component includes a body including magnetic particles and an insulating resin, and a coil portion disposed within the body. The body has a multilayer structure including a core portion covering the coil portion and a cover portion covering the core portion. The magnetic particles included in the core portion have a distribution of a particle size having a $D_{50}$ of 3.5 μm or less.

14 Claims, 4 Drawing Sheets

(56) References Cited

U.S. PATENT DOCUMENTS

| | | | | |
|---|---|---|---|---|
| 2016/0180995 | A1* | 6/2016 | Park | H01F 17/0013 29/606 |
| 2016/0276096 | A1 | 9/2016 | Moon et al. | |
| 2016/0293315 | A1* | 10/2016 | Kim | H01F 17/0013 |
| 2016/0351315 | A1 | 12/2016 | Park et al. | |
| 2017/0140864 | A1* | 5/2017 | Arai | H01F 27/245 |
| 2017/0221622 | A1* | 8/2017 | Park | H01F 27/29 |
| 2017/0294260 | A1* | 10/2017 | Ishida | C22C 38/02 |
| 2017/0309388 | A1* | 10/2017 | Park | H01F 27/29 |
| 2018/0033533 | A1* | 2/2018 | Ryu | H01F 17/0013 |
| 2018/0308612 | A1* | 10/2018 | Park | H01F 27/292 |
| 2019/0287815 | A1* | 9/2019 | Xu | H01F 41/24 |

FOREIGN PATENT DOCUMENTS

| | | | |
|---|---|---|---|
| JP | 2015-142074 | A | 8/2015 |
| JP | 2015-230966 | A | 12/2015 |
| JP | 2016-225604 | A | 12/2016 |
| JP | 2017-195361 | A | 10/2017 |
| KR | 10-2013-0104807 | A | 9/2013 |
| KR | 10-2016-0076840 | A | 7/2016 |
| KR | 10-2016-0112185 | A | 9/2016 |
| KR | 10-1792281 | B1 | 11/2017 |
| KR | 10-2018-0009652 | A | 1/2018 |

* cited by examiner

COIL ELECTRONIC COMPONENT

CROSS-REFERENCE TO RELATED APPLICATION(S)

This application claims the benefit under 35 USC 119 (a) of Korean Patent Application No. 10-2018-0133371 filed on Nov. 2, 2018 in the Korean Intellectual Property Office, the entire disclosure of which is incorporated herein by reference for all purposes.

TECHNICAL FIELD

The present disclosure relates to a coil electronic component.

BACKGROUND

Inductors, coil electronic components, are representative passive elements forming electronic circuits, together with resistors and capacitors to remove noise.

A thin film type inductor is manufactured by forming an internal coil portion by plating and then curing a magnetic powder-resin composite in which a magnetic powder and a resin are mixed to manufacture a body and forming an external electrode on an external surface of the body.

In the related art, to secure a magnetic saturation region, particles having different particle size distributions are mixed and used. However, due to the large particle size, the sheet thickness cannot be formed to be thick, and it is difficult to exhibit a high DC bias effect (a change in inductance due to current application). For example, in the case in which particles having a large particle size are used, magnetic saturation magnetization (Ms) is lower than that in the case of using particles having a small particle size, thereby causing shortcomings of delaying magnetic flux saturation. Furthermore, in the case of using small-sized particles, as there is limitation in thinning the magnetic sheet itself, implementing capacity may be difficult.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

An aspect of the present disclosure is to provide a coil component ensuring excellent DC-Bias characteristics (a change characteristics of inductance by current application) and a degree of freedom in lamination design.

According to an aspect of the present disclosure, a coil electronic component includes a body including magnetic particles and an insulating resin, and a coil portion disposed within the body. The body has a multilayer structure, including a core portion covering the coil portion and a cover portion covering the core portion. The magnetic particles included in the core portion have a distribution of a particle size having a $D_{50}$ of 3.5 μm or less.

BRIEF DESCRIPTION OF THE DRAWINGS

Throughout the drawings and the detailed description, the same reference numerals refer to the same elements. The drawings may not be to scale, and the relative size, proportions, and depiction of elements in the drawings may be exaggerated for clarity, illustration, and convenience.

DETAILED DESCRIPTION

The following detailed description is provided to assist the reader in gaining a comprehensive understanding of the methods, apparatuses, and/or systems described herein. However, various changes, modifications, and equivalents of the methods, apparatuses, and/or systems described herein will be apparent to one of ordinary skill in the art. The sequences of operations described herein are merely examples, and are not limited to those set forth herein, but may be changed as will be apparent to one of ordinary skill in the art, with the exception of operations necessarily occurring in a certain order. Also, descriptions of functions and constructions that are well known to one of ordinary skill in the art maybe omitted for increased clarity and conciseness.

The features described herein may be embodied in different forms, and are not to be construed as being limited to the examples described herein. Rather, the examples described herein have been provided so that this disclosure will be thorough and complete, and will convey the full scope of the disclosure to one of ordinary skill in the art.

The terminology used herein describes particular embodiments only, and the present disclosure is not limited thereby. As used herein, the singular forms "a," "an," and "the" are intended to include the plural forms as well, unless the context clearly indicates otherwise. It will be further understood that the terms "including", "comprises," and/or "comprising" when used in this specification, specify the presence of stated features, integers, steps, operations, members, elements, and/or groups thereof, but do not preclude the presence or addition of one or more other features, integers, steps, operations, members, elements, and/or groups thereof.

Hereinafter, examples of the present disclosure will be described in detail with reference to the accompanying drawings so that those skilled in the art may easily carry out the present disclosure.

Coil Electronic Component

Hereinafter, a coil electronic component according to an embodiment will be described with a thin film inductor as an example, but an embodiment thereof is not limited thereto.

Figure 1:
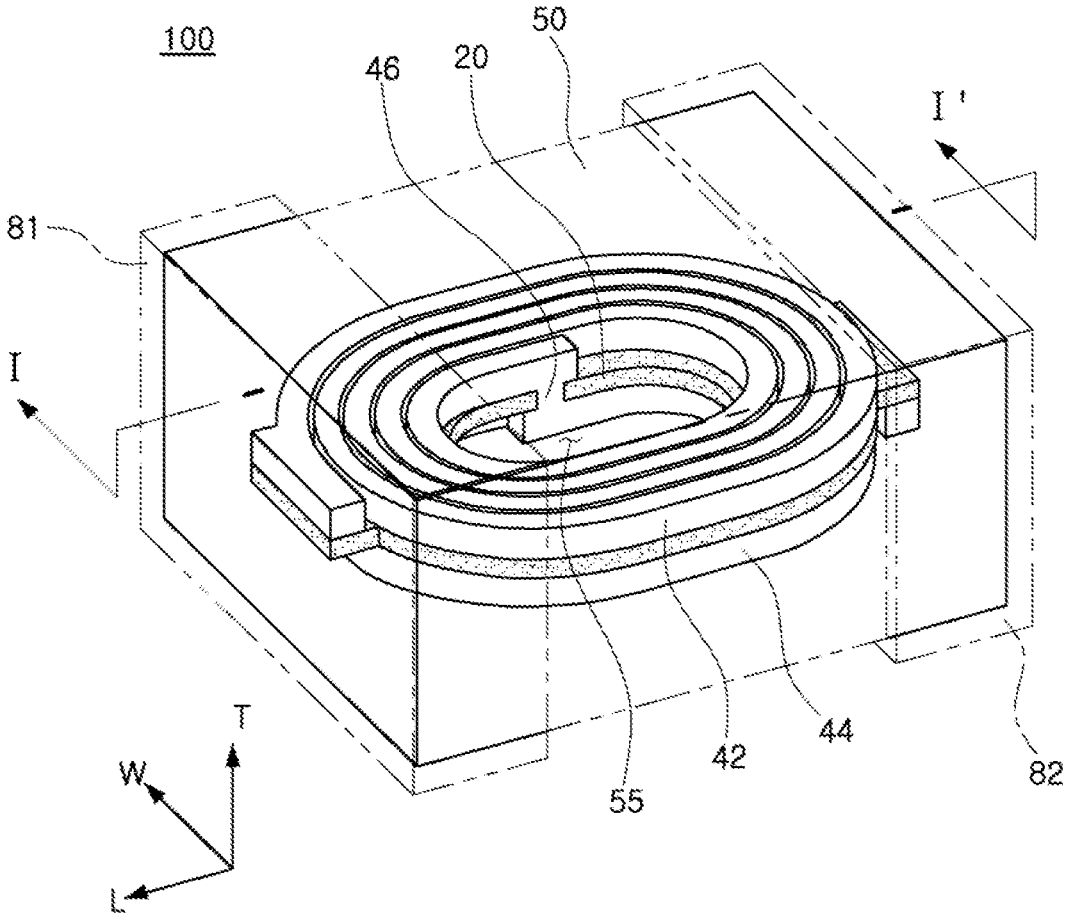
FIG. 1 is a schematic perspective view of an internal coil portion of a coil electronic component according to an embodiment of the present disclosure.

FIG. 1 is a schematic perspective view of an internal coil portion of a coil electronic component according to an embodiment.

Referring to FIG. 1, a thin film inductor used for a power supply line of a power supply circuit is provided as an example of a coil electronic component. A coil electronic component 100 according to an embodiment includes a body 50, internal coil portions 42 and 44 embedded in the body 50, and first and second external electrodes 81 and 82 disposed on external surfaces of the body 50 to be connected to the internal coil portions 42 and 44.

In the coil electronic component 100 according to an embodiment, a length direction is defined as the 'L' direction, a width direction as the 'W' direction, and a thickness direction as the 'T' direction in FIG. 1.

A material of the body 50 is not particularly limited as long as it exhibits magnetic characteristics while forming the appearance of a thin film inductor 100, and for example, the body 50 may include magnetic particles.

The magnetic particles maybe a crystalline or amorphous metal including at least one selected from the group consisting of iron (Fe), silicon (Si), chromium (Cr), Cu, Al, molybdenum (Mo) and Ni.

The magnetic particles may be dispersed in a thermosetting resin such as polyimide, an epoxy resin or the like.

A coil-shaped first internal coil portion 42 is formed on one surface of an insulating substrate 20 disposed inside the body 50. A coil-shaped second internal coil portion 44 is formed on the other surface of the insulating substrate 20, opposing the one surface of the insulating substrate 20.

The first and second internal coil portions 42 and 44 may be formed by performing electroplating.

The insulating substrate 20 is formed of, for example, a polypropylene glycol (PPG) substrate, a ferrite substrate, a metal-based soft magnetic substrate, or the like.

A through-hole is formed by penetrating through a central portion of the insulating substrate 20, and the through-hole is filled with a magnetic material to form a core portion 41*a*. Inductance Ls may be improved by forming the core portion 41*a* filled with the magnetic material.

The first and second internal coil portions 42 and 44 may be formed to have a spiral shape. The first and second internal coil portions 42 and 44 formed on one surface and the other surface of the insulating substrate 20 are electrically connected to each other through a via 46 formed by penetrating through the insulating substrate 20.

The first and second internal coil portions 42 and 44 and the via 46 maybe formed to include a metal having excellent electrical conductivity. For example, the first and second internal coil portions 42 and 44 and the via 46 may be formed of silver (Ag), palladium (Pd), aluminum (Al), nickel (Ni), titanium (Ti), gold (Au), copper (Cu), platinum (Pt) or alloys thereof.

One end of the first internal coil portion 42 formed on one surface of the insulating substrate 20 is exposed to one end of the body 50 in the length length L, and one end of the second internal coil portion 44 formed on the other surface of the insulating substrate 20 is exposed to the other end of the body 50 in the length direction L.

However, embodiments thereof are not necessarily limited thereto, and one end of each of the first and second internal coil portions 42 and 44 may be exposed to at least one surface of the body 50.

First and second external electrodes 81 and 82 are formed on external surfaces of the body 50 to be connected to the first and second internal coil portions 42 and 44 exposed to the end surfaces of the body 50, respectively.

The first and second external electrodes 81 and 82 may be formed to include a metal having excellent electrical conductivity, and may be formed of, for example, Ni, Cu, Sn, Ag, or the like, alone or alloys thereof.

Figure 2:
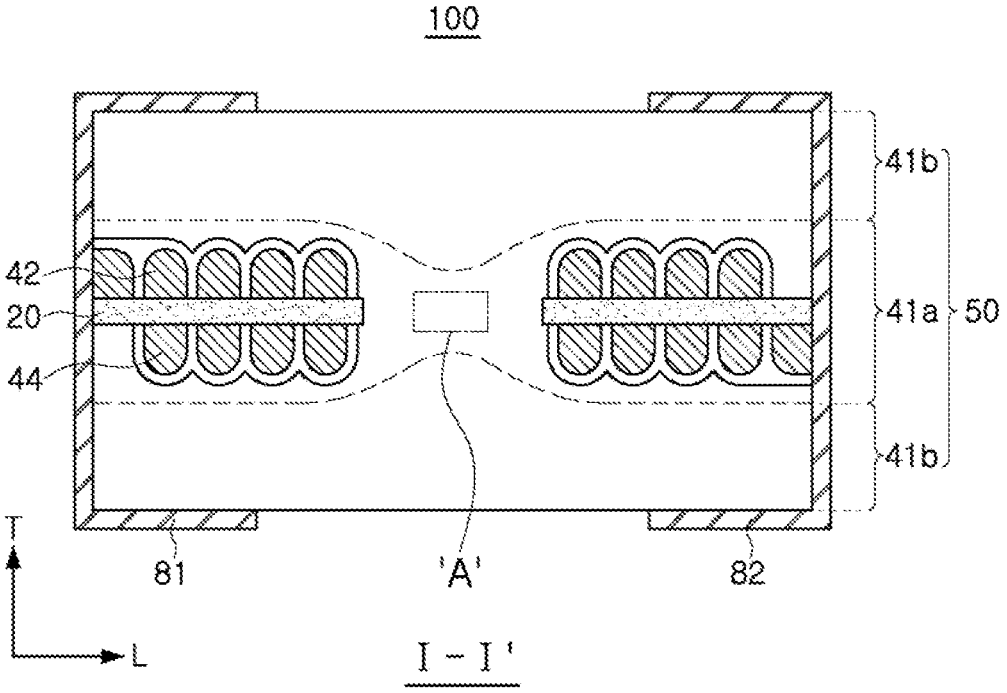
FIG. 2 is a cross-sectional view taken along line I-I' in FIG. 1.

FIG. 2 is a cross-sectional view taken along line I-I' in FIG. 1.

Referring to FIG. 2, the body 50 according to an embodiment includes a core portion 41*a* and a cover portion 41*b* that is distinct from the core portion 41*a*.

A boundary between the core portion 41*a* and the cover portion 41*b* adjacent to each other may be confirmed by using a scanning electron microscope (SEM). However, the core portion 41*a* and the cover portion 41*b* are not necessarily limited to being distinct from each other by a boundary observed by a scanning electron microscope (SEM). For example, as at least one of the types of magnetic sheets 51, 52 and 53 included in the core portion 41*a* and the cover portion 41*b* is different from the remaining sheets, a boundary between the core portion 41*a* and the cover portion 41*b* may be formed as a discontinuous interface therebetween, such that the core portion 41*a* may be distinguished from the cover portion 41*b*.

Figure 3:
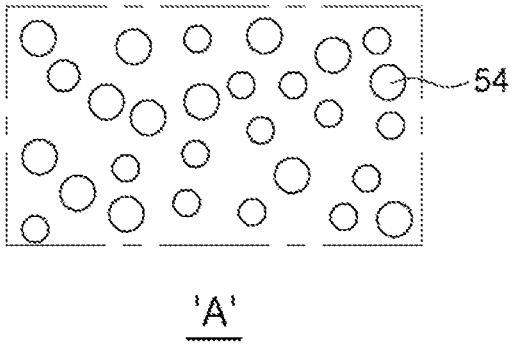
FIG. 3 illustrates a particle size distribution of magnetic particles according to an embodiment of the present disclosure.

Referring to FIG. 3, the core portion 41*a* according to an embodiment includes magnetic particles having a $D_{50}$ of 3.5 μm or less. The cover portion 41*b* may also include magnetic particles having a $D_{50}$ of 3.5 μm or less.

As used herein, $D_{50}$ refers to the median diameter or the medium value of the particle size distribution. In other words, $D_{50}$ is the value of the particle diameter at 50% in the cumulative distribution of particle sizes. For example, if $D_{50}$ is 3.5 μm, then 50% of the particles in the sample are larger than 3.5 μm and 50% are smaller than 3.5 μm. The $D_{50}$ value is a given sample is measured using a particle diameter and particle size distribution measuring apparatus using a laser diffraction scattering method.

The types of magnetic particles included in the core portion 41*a* and the cover portion 41*b* include carbonyl iron powder (CIP) formed of iron.

The particle size distribution of the magnetic particles included in the core portion 41*a* and the cover portion 41*b* according to an embodiment maybe different from each other.

In the case of magnetic particles having a relatively large $D_{50}$, high magnetic permeability may be implemented. In the case of magnetic particles having a small $D_{50}$, the magnetic particles exhibit a low magnetic permeability, but in this case, since the high permeability material with low loss is used to serve to compensate for an increased core loss, surface roughness may be improved and plating blurring caused by particles having a large particle size may be reduced.

The $D_{50}$ of the magnetic particles included in the core portion 41*a* and the cover portion 41*b* is not necessarily limited to the above example. Thus, in this case, it means that the core portion 41*a* and the cover portion 41*b* include magnetic particles of different $D_{50}$s. In addition, the core portion 41*a* may be formed by laminating magnetic sheets having a thickness in a range from 10 μm to 80 μm, inclusive, and having magnetic particles having a $D_{50}$ of 3.5 μm or less.

The core portion 41*a* and the cover portion 41*b* may be laminated vertically.

The core portion 41*a* and the cover portion 41*b* may be respectively formed by laminating magnetic sheets. The core portion 41*a* and the cover portion 41*b* may be formed using three or more kinds of magnetic sheets having different $D_{50}$s of magnetic particles included therein.

Therefore, the core portion 41*a* and the cover portion 41*b* are formed by laminating the magnetic sheets, and are thus disposed in upper and lower positions vertically.

As illustrated in FIG. 2, in the case of the body 50 according to an embodiment, the core portion 41*a* may be formed in a core layer in which the first and second internal coil portions 42 and 44 are located, and the cover portion 41*b* may be formed on an upper portion and a lower portion of the core portion 41*a*.

A central portion of the core portion 41*a* may be formed to have a concave shape in a process of forming the core portion 41*a* and the cover portion 41*b* by laminating, pressing and curing magnetic sheets.

As described above, in the case of the coil electronic component 100 according to an embodiment, the magnetic sheets 51, 52 and 53 formed of magnetic particles having $D_{50}$ of 3.5 μm or less and having different thicknesses are laminated, in such a manner that the core portion 41*a* is distinct from the cover portion 41*b*, thereby forming the body 50, and thus implementing the degree of freedom of lamination design and the DC-Bias characteristics.

Figure 4:
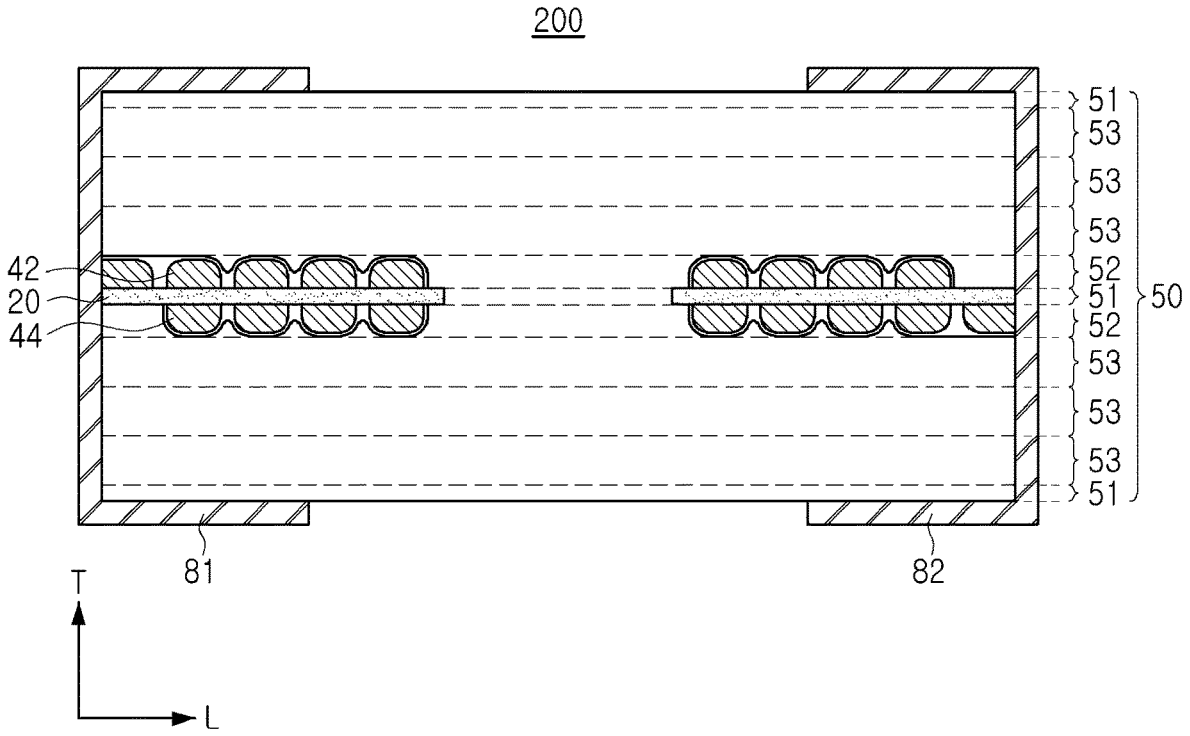
FIG. 4 is a cross-sectional view of a coil electronic component in an L-T direction according to another embodiment of the present disclosure.
Figure 5:
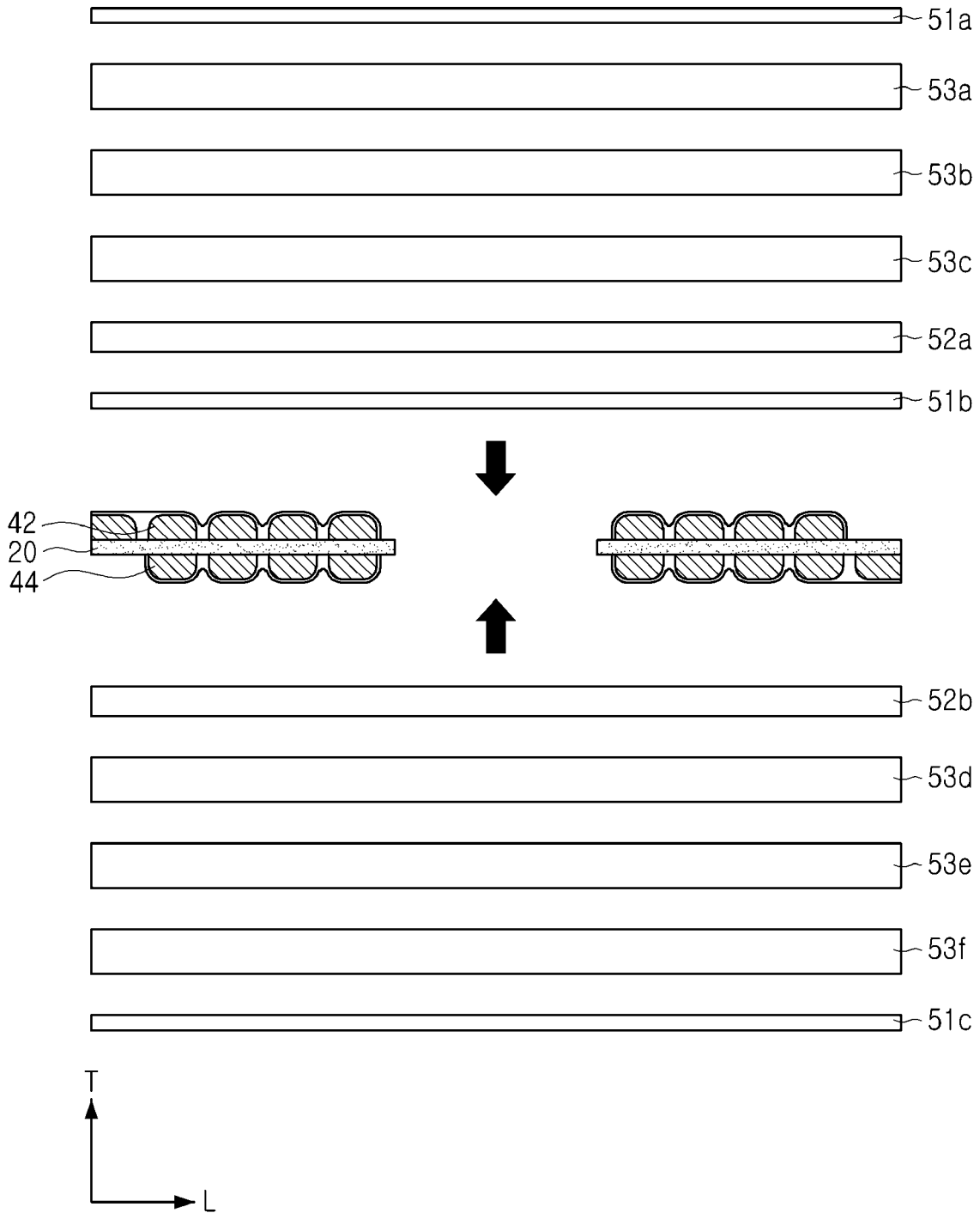
FIG. 5 is a view illustrating a process of forming a body of a coil electronic component according to another embodiment of the present disclosure.

FIGS. 4 to 5 are sectional views of a coil electronic component in an L-T direction according to an embodiment.

Referring to FIG. 4, the body 50 according to an embodiment includes the core portion 41*a* formed in a central portion thereof and the cover portion 41*b* formed in an upper portion or a lower portion of the body 50.

Referring to FIG. 4, the body 50 according to another embodiment may be formed by alternately laminating the core portion 41*a* and the cover portion 41*b*.

In this case, the ratio of thicknesses of the core portion 41*a* and the cover portion 41*b* alternately stacked, the number of times of alternation of the core portions 41*a* and the cover portions 41*b*, and the like are not particularly limited, and may be variously adjusted depending on characteristics to be implemented. On the other hand, the core portion 41*a* may have a structure in which the second and third magnetic sheets 52 and 53 are laminated a plurality of times to have a thickness in a range from 10 μm to 80 μm, inclusive, in terms of securing the lamination design freedom and relatively high DC-bias characteristics. According to an embodiment, three kinds of magnetic sheets 51, 52 and 53 having different thicknesses of 10 μm, 30 μm and 80 μm are laminated. For example, the magnetic sheet having a thickness of 10 μm may formed in a central portion of the core portion 41*a*, and magnetic sheets of thickness of 30 μm and 80 μm may be sequentially formed in a direction toward the cover portion 41*b*. By filling the core portion 41*a* with the magnetic sheet having a relatively high resin content as described above, a leakage current of the coil may be prevented, and bonding strength of the core portion may be improved. In addition, DC-bias characteristics may be implemented by applying a sheet having a high saturation magnetization (Ms) value of 200 or more. Further, the magnetic sheet having a relatively high resin content, which is implemented in an embodiment, may be located on the coil portion to improve the flatness of a chip and to suppress plating spread, thereby enhancing the strength of chip. On the other hand, the cover portion 41*b*, which is formed sequentially on the core portion, has a structure in which the first magnetic sheet 51 is laminated to a thickness of 10 μm to secure the degree of freedom in the lamination design.

As described above, in the case of the coil electronic component 100 according to an embodiment, the magnetic sheets 51, 52 and 53 formed of magnetic particles having $D_{50}$ of 3.5 μm or less and having different thicknesses are laminated, in such a manner that the core portion 41*a* is distinct from the cover portion 41*b*, thereby forming the body 50, and thus implementing the degree of freedom of lamination design and DC-Bias characteristics.

Method of Manufacturing Coil Electronic Component

In a method of manufacturing a coil electronic component according to an embodiment, first, second and third magnetic sheets including magnetic particles are provided.

The first, second and third magnetic sheets may be manufactured as a sheet by mixing an organic material such as magnetic particles, a binder and a solvent to prepare a slurry and by applying the slurry onto a carrier film to a thickness of several tens of micrometers by a doctor blade method, followed by drying.

In this case, the first, second and third magnetic sheets may be produced as three or more type sheets formed of magnetic particles having distribution of a particle size $D_{50}$ of 3.5 μm or less and having different thicknesses.

FIG. 5 is a view illustrating a process of forming an internal coil portion of a coil electronic component according to another embodiment.

Referring to FIG. 5, the body 50 may be formed by laminating three or more magnetic sheets having different thicknesses in the range from 10 μm to 80 μm, inclusive on the upper and lower portions of the internal coil portions 42 and 44. A first magnetic sheet 51*b* having a thickness of 10 μm, second magnetic sheets 52*a* and 52*b* having a thickness of 30 μm, and third magnetic sheets 53*c*, 53*d*, 53*b*, 53*e*, 53*a* and 53*f* having a thickness of 80 μm may be laminated in the core portion including a coil portion, and first magnetic sheets 51*a* and 51*c* having a thickness of 10 μm may be laminated in the cover portion in order. Although the lamination order is not limited to the above-described embodiment, a thin-layer sheet formed of magnetic particles having a $D_{50}$ of 3.5 μm or less may be interposed in a central portion of the core portion to secure freedom of lamination design and delay DC magnetization saturation. Further, a relatively thick sheet of 80 μm and then a sheet of 30 μm may be laminated on a thin layer sheet of 10 μm to reduce surface roughness and ensure reliability. On the other hand, the cover portion 41*b* maybe formed of a thin layer sheet of 10 μm to ensure a degree of freedom in lamination design.

Referring to FIG. 5, a body 50 according to another embodiment may be formed by alternately stacking the core portion 41*a* and the cover portion 41*b*.

However, the thickness ratio of the core portion 41*a* and the cover portion 41*b* alternately stacked, the number of times of alternation of the core portions 41*a* and the cover portions 41*b*, and the like are not particularly limited, and may be adjusted variously depending on characteristics to be implemented.

The body 50 may be formed by stacking the first and second magnetic sheets, followed by pressing through lamination or hydrostatic pressing, and followed by curing.

The first, second and third magnetic sheets illustrated in FIG. 5 are for explaining embodiments in which the magnetic sheet is laminated, and the thickness of the magnetic sheet and the number of times of lamination are not limited thereto.

Descriptions of other components that are the same as those of the coil electronic component according to the above-described embodiment will be omitted.

As set forth above, according to an embodiment, a coil electronic component in which excellent DC-Bias characteristics (change characteristics of inductance by current application) and degree of freedom in lamination design may be secured may be implemented.

While this disclosure includes specific examples, it will be apparent to one of ordinary skill in the art that various changes in form and details maybe made in these examples without departing from the spirit and scope of the claims and their equivalents. The examples described herein are to be considered in a descriptive sense only, and not for purposes of limitation. Descriptions of features or aspects in each example are to be considered as being applicable to similar features or aspects in other examples. Suitable results may be achieved if the described techniques are performed in a different order, and/or if components in a described system, architecture, device, or circuit are combined in a different manner, and/or replaced or supplemented by other components or their equivalents. Therefore, the scope of the disclosure is defined not by the detailed description, but by the claims and their equivalents, and all variations within the scope of the claims and their equivalents are to be construed as being included in the disclosure.

What is claimed is:

1. A coil electronic component comprising:

a body including magnetic particles and an insulating resin; and a coil portion disposed within the body, wherein the body has a multilayer structure including a core portion covering the coil portion and a cover portion covering the core portion, wherein the magnetic particles included in the core portion have a distribution of a particle size having a $D_{50}$ of 3.5 μm or less, wherein the core portion comprises at least three kinds of magnetic sheets having different thicknesses, and wherein a central layer of the at least three kinds of magnetic sheets in a center of the core portion and a magnetic sheet of the cover portion are thinner than the at least three kinds of magnetic sheets other than the central layer.

2. The coil electronic component of claim 1, wherein the core portion and the cover portion form a discontinuous interface.

3. The coil electronic component of claim 1, wherein the magnetic particles included in the cover portion have a $D_{50}$ of 3.5 μm or less.

4. The coil electronic component of claim 1, wherein the core portion has a thickness in a range from 10 μm to 80 μm, inclusive.

5. The coil electronic component of claim 1, wherein a thickness of the cover portion is in a range from 10 μm to 80 μm, inclusive.

6. The coil electronic component of claim 4, wherein the core portion is provided with three or more kinds of magnetic sheets having different thicknesses laminated therein.

7. The coil electronic component of claim 1, wherein a magnetic saturation magnetization (Ms) value of the core portion is 200 emu/g or more.

8. The coil electronic component of claim 1, wherein the magnetic particles included in the core portion are carbonyl iron powder (CIP).

9. A coil electronic component comprising:

a coil portion; and a body enclosing the coil portion and comprising:

a core portion comprising carbonyl iron powder and an insulating resin, and a cover portion disposed over the core portion and having a discontinuous interface with the core portion, wherein the core portion comprises at least three kinds of magnetic sheets having different thicknesses, and wherein a central layer of the at least three kinds of magnetic sheets in a center of the core portion and a magnetic sheet of the cover portion are thinner than the at least three kinds of magnetic sheets other than the central layer.

10. The coil electronic component of claim 9, wherein the cover portion comprises magnetic particles and an insulating resin.

11. The coil electronic component of claim 10, wherein the magnetic particles of the cover portion have a $D_{50}$ of 3.5 μm or less.

12. The coil electronic component of claim 1, wherein all of the magnetic particles included in the core portion have the distribution of a particle size having a $D_{50}$ of 3.5 μm or less.

13. A coil electronic component comprising:

a coil portion; and a body enclosing the coil portion and comprising:

a core portion comprising carbonyl iron powder and an insulating resin, and a cover portion disposed over the core portion and having a discontinuous interface with the core portion, wherein all magnetic particles included in the core portion have the distribution of a particle size having a $D_{50}$ of 3.5 μm or less, wherein the core portion comprises at least three kinds of magnetic sheets having different thicknesses, and wherein a central layer of the at least three kinds of magnetic sheets in a center of the core portion and a magnetic sheet of the cover portion are thinner than the at least three kinds of magnetic sheets other than the central layer.

14. The coil electronic component of claim 9, wherein magnetic particles of the core portion have a $D_{50}$ of 3.5 μm or less, and wherein the core portion has a thickness in a range from 10 μm to 80 μm, inclusive.

* * * * *